United States Patent [19]

Murphy

[11] Patent Number: 4,464,602

[45] Date of Patent: Aug. 7, 1984

[54] THIN FILM ELECTROLUMINESCENT DEVICE

[75] Inventor: Joseph Murphy, Pittsburgh, Pa.

[73] Assignee: The United States of America as represented by the Secretary of the Army, Washington, D.C.

[21] Appl. No.: 343,656

[22] Filed: Jan. 28, 1982

[51] Int. Cl.[3] ..... H05B 33/12

[52] U.S. Cl. ..... 313/509

[58] Field of Search ..... 313/509, 506

[56] References Cited

U.S. PATENT DOCUMENTS

| | | | |
|---|---|---|---|
| 2,824,992 | 2/1958 | Bouchard et al. | 313/509 |
| 2,924,732 | 2/1960 | Lehmann | 313/506 |
| 3,388,277 | 6/1968 | Thornton, Jr. | 313/509 |
| 4,326,007 | 4/1982 | Williams et al. | 313/509 X |

FOREIGN PATENT DOCUMENTS

| | | | |
|---|---|---|---|
| 2810524 | 9/1978 | Fed. Rep. of Germany | 313/509 |

OTHER PUBLICATIONS

*Topics in Applied Physics*, vol. 17, 1977, J. I. Pankove, Ed., Chapter 6 entitled, "Phosphor Films", by T. Inoguchi and S. Mito at pp. 199 and 200 discloses a triple layer structure of a thin film electroluminescent device wherein the intermediate active layer is ZnS:Mn and outer insulating layers could be $Y_2O_3$.

*Primary Examiner*—Palmer Demeo

*Attorney, Agent, or Firm*—Anthony T. Lane; Jeremiah G. Murray; John W. Redman

[57] ABSTRACT

The structure of a thin film electroluminescent device wherein an insulating layer ($Y_2O_3$) is disposed between a pair of outer active layers of doped semiconductor (ZnS:Mn). Contiguous to one outer layer of ZnS:Mn is a metal electrode while a transparent electrode is contiguous to the other outer ZnS:Mn layer. The composite structure, moreover, is formed on and supported by a glass substrate. Electroluminescent phenomenon occurs primarily at the layer interfaces upon the application of an alternating voltage applied across electrodes. Such a structure is more resistant to failure due to the fact that the ZnS:Mn layers next to the electrodes act as current limiting layers for preventing breakdown and destruction of the metal electrode for a certain applied voltage which would otherwise occur in electroluminescent structures having the active ZnS:Mn layer sandwiched between two insulating layers.

13 Claims, 3 Drawing Figures

THIN FILM ELECTROLUMINESCENT DEVICE

The government has rights in this invention pursuant to Contract No. DAABO7-77-C-2697 awarded by the Department of the Army.

CROSS REFERENCE TO RELATED APPLICATION

This application is related to U.S. Ser. No. 343,657 (CERCOM D-2169) entitled, "Multi-Layered Thin Film Electroluminescent Structure", which was filed on behalf of the subject inventor on Jan. 28, 1982. This application is assigned to the assignee of the present invention and is meant to be specifically incorporated herein by reference.

BACKGROUND OF THE INVENTION

This invention relates to electroluminescent devices and more particularly to electroluminescent devices of the thin film type.

Luminescence is a phenomenon which occurs in gases, liquids and solids wherein exciting energy which may come from light, an electron beam, or passage of an electric current therethrough raises atoms or molecules to higher energy levels and wherein emission of radiation thereafter occurs as particles fall back to lower energy levels. Since atoms and molecules can have only certain discrete energies, these processes can occur only in jumps. For each jump, the emitted radiation has a frequency given by the energy jump divided by Planck's constant.

Intrinsic electroluminescence was discovered by G. Destriau in 1936 by exposing phosphor materials to high electric fields. It was not until some time later that a practical device was developed consisting of a dispersion type of electroluminescent structure. Such a structure is comprised of activated phosphor powder dispersed in a layer of insulating substance. Such a device exhibits very poor brightness, efficiency and a relatively short useful life. Although recent advances in electronics and material science has enhanced the development of such devices, the advent of thin film technology has resulted in the development of a significant improvement comprising a double insulating layer structure. There a vacuum deposited thin phosphor film replaces the dispersion layer structure. The problems related to short life and low brightness, the major obstacles that hindered practical application up to that time have been substantially resolved thereby. The vacuum deposited thin film electroluminescent device with a double insulating layer structure, while exhibiting a relatively higher brightness and longer life, was found to have an inherent weakness in that any breakdown in the insulating layer adjacent the outer electrode was followed by a catastrophic effect of the electrode due to the localized high current conductivity which occurred initially at the point of breakdown and which subsequently spread until ultimate failure of the device occurred.

Accordingly, it is an object of the present invention to provide an improvement in electroluminescent devices.

It is a further object of the present invention to provide an improvement in the construction of thin film electroluminescent devices.

Still another object of the present invention is to provide an improvement in the structure of thin film electroluminescent devices which exhibit an enhanced resistance to failure.

SUMMARY

Briefly, the foregoing and other objects of the invention are provided by an electroluminescent device having a thin film structure comprised of at least one pair of active electroluminescent layers enveloping a single insulating layer with the three layers being located between a pair of electrodes across which is applied an AC excitation voltage. One of the electrodes comprises a transparent electrode formed on a transparent supporting substrate such as glass from which light generated by the device emerges. The other electrode comprises an outer layer of metal such as aluminum (Al). The active layers are preferably comprised of thin films of zinc sulfide (ZnS) doped with manganese (Mn) while the insulating layer is comprised of a thin film of yttrium oxide ($Y_2O_3$) or any other high strength dielectric constant material such as barium titanate ($BaTiO_3$). The outer active layers adjacent the electrodes provide a current limiting means for preventing breakdown between the electrodes through the insulating layer. When desirable, plural pairs of active layers including a respective insulating layer are provided between the electrodes.

BRIEF DESCRIPTION OF THE DRAWING

While the present invention is described in particularity for providing a basis for the claims annexed to and forming a part of this specification, a better understanding of the invention can be had by reference to the following description taken in conjunction with the accompanying drawings in which:

DESCRIPTION OF THE PREFERRED EMBODIMENTS

Figure 1:
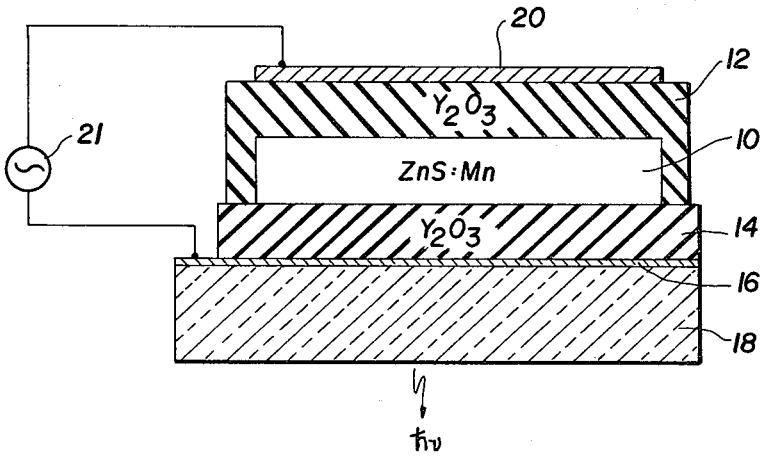
FIG. 1 PRIOR ART
FIG. 1 is a cross sectional view typically illustrative of a known prior art thin film electroluminescent device.

Referring now to the figures and more particularly to FIG. 1, there is shown the fundamental structure of an electroluminescent device according to the known prior art. The device in FIG. 1 consists of a triple layer structure having an active layer 10 sandwiched between two insulating layers 12 and 14. The active layer 10 is comprised of zinc sulfide doped with 0.5 atomic %–3 atomic % manganese (ZnS:Mn). The insulating layers 12 and 14 are comprised of a high dielectric strength, high dielectric constant material preferably yttrium oxide ($Y_2O_3$). When desirable, other such insulating materials can be utilized, for example, silicon nitride ($Si_3N_4$), aluminum oxide ($Al_2O_3$) or barium titanate ($BaTiO_3$). The three layers 10, 12 and 14 are located between a transparent electrode 16 formed on a glass substrate 18 and a metal electrode 20. The transparent electrode 16 typically is comprised of indium-tin oxide $(In,Sn)O_2$. The upper metal electrode 20 typically comprises a layer of aluminum (Al). Although not shown, the device as shown in FIG. 1 often includes an additional outer insulating layer to protect the device, for example, from humidity. The fabrication techniques for providing a thin film electroluminescent device as shown in FIG. 1 are well known. One such method as well as the structure itself is shown and described at pages 199 and 200 of Chapter 6, "Phosphor Films" by T. Inoguchi and S. Mito in a publication entitled, *Topics In Applied Physics*, Volume 17, 1977, J. I. Pankove, Ed.

In operation, when an alternating current source 22 is coupled across the transparent $SnO_2$ electrode 16 and the outer Al metal electrode 20, the active ZnS:Mn active layer 10 will luminesce and light emitted therefrom will be externally conducted from the structure through the insulating layer 14, the transparent electrode 16 and the glass substrate 18.

While the prior art device as shown in FIG. 1 operates in a satisfactory manner, it is nevertheless subject to breakdown of the dielectric insulating layers, particularly the layer 12 next to metal electrode 20 upon the application of either an unusually high applied voltage or a defect exists or develops within the insulating layers themselves. When this occurs, an abnormally high sustained discharge path develops which causes a catastrophic failure of the metal electrode 20.

Figure 2:
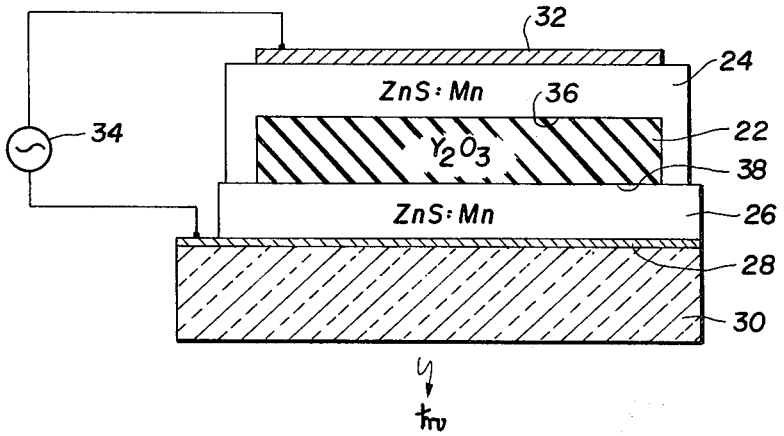
FIG. 2 is a cross sectional view illustrative of the preferred embodiment of the subject invention.
Figure 3:
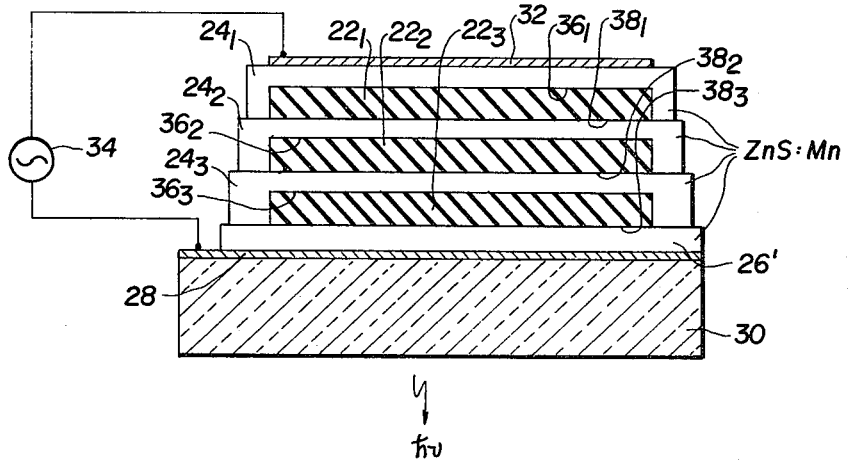
FIG. 3 is a cross sectional view illustrative of an alternative embodiment to that shown in FIG. 2.

Referring now to the two embodiments of the invention shown in FIGS. 2 and 3, the subject invention evolves from a better understanding of the mechanism of the thin film electroluminescent phenomenon wherein it has been found that electroluminescence primarily occurs at the interfaces between the active material and the insulating material. Accordingly, the present invention is based upon reversing the order of the active and insulating layers between the electrodes across which the excitation voltage is applied. The purpose of this reversal is to make use of a current limiting effect which is capable of being provided by the active layers thus leading to the prevention of catastrophic breakdown which is capable of occurring in prior art devices.

As shown in FIG. 2, a single insulating layer 22 of $Y_2O_3$ is sandwiched betweeen two outer layers of ZnS:Mn 24 and 26. The lower ZnS:Mn layer 26 is contiguous to a transparent $(In,Sn)O_2$ inner electrode layer 28 formed on a glass substrate 30 while the upper ZnS:Mn layer 24 is contiguous to an outer metal electrode 32 which again is preferably in the form of an Al film. When an AC excitation voltage is applied across electrodes 32 and 28 from a source 34, electroluminescence will primarily occur at the interfaces 36 and 38. This phenomenon is more fully explained in the above cross referenced related application, U.S. Ser. No. 343,657 entitled, "Multi-Layered Thin Film Electroluminescent Structure".

What is particularly significant about the device shown in FIG. 2 is the existence of the ZnS:Mn layers 22 and 26 adjacent electrodes 32 and 28, resepectively. Because these layers exhibit a predetermined resistivity, they additionally act as current limiting layers, a function heretofore unobtainable. Furthermore, it has been found that with such a structural configuration, a device as shown in FIG. 2 will fail only in a single spot which becomes non-conducting after the collapse of the excitation, thus saving the electrode 32 and accordingly the device from complete destruction.

Typically, a device such as shown in FIG. 2 is fabricated in the following manner, although it should be observed that a variety of materials, thicknesses and doping levels can be substituted when desirable. First, a clean glass substrate 30 is coated with a transparent conducting film 28 of $(In,Sn)O_2$. The substrate 30 is next heated to a temperature of 215° C. whereupon a semiconducting film 26 comprised of zinc sulfide doped with 2 wt.% manganese is deposited thereon to a thickness, typically, of 2500 Å. Following the deposition of the first ZnS:Mn film 26, a film 22 of $Y_2O_3$ is deposited thereon to a thickness of 4,000 Å. Next, a second layer 24 of ZnS:Mn is deposited to a thickness of 2500 Å. The film fabricated to this point is next annealed at approximately 400° C. for approximately five hours. When the composite structure thus fabricated has cooled to room temperature, a top electrode 32 of aluminum is deposited thereon.

A completed device fabricated in accordance with the above method can be excited with an AC voltage source at 500 Hz, for example, which will start to emit light at approximately 70 volts and will increase in brightness as the voltage is raised. Experimental samples have been known to operate as high as 200 volts without breakdown, thus providing a major advantage over conventional prior art structures as shown in FIG. 1.

Referring now to FIG. 3, modification of the embodiment shown in FIG. 2 is disclosed wherein multiple insulating layers $22_1$, $22_2$ and $22_3$ are sandwiched between outer ZnS:Mn layers $24_1$, $24_2$, $24_3$ and 26. The combined thicknesses of the three insulating layers $22_1$, $22_2$ and $22_3$ corresponds to the thickness of the single insulating layer 22 of FIG. 2 while the combined thicknesses of the active layers $24_1$, $24_2$ and $24_3$ as well as the thickness of the layer 26' corresponds to the total thicknesses of the two ZnS:Mn layers 24 and 26 of FIG. 2. The purpose of such a configuration is to provide multiple pairs of interfaces $36_1$, $38_1$ . . . $36_3$, $38_3$ in order to increase the number of electrons trapped in interface states and thus yielding a device providing a proportionately higher electroluminescent light output.

Thus what has been shown and described is an improved thin film electroluminescent structure which is not only capable of providing high brightness, but is inherently less susceptible to catastrophic failure.

Accordingly, while there has been shown and described what is at present considered to be the preferred embodiments of the invention, it should be observed that the foregoing detailed description has been made by way of illustration and not limitation, and therefore all alterations, modifications and changes coming within the spirit and scope of the invention as defined in the appended claims are herein meant to be included.

What is claimed is:

1. An electroluminescent device, comprising in combination:

at least one pair of identically composed active electroluminescent layers;

an insulating layer disposed between said pair of electroluminescent layers forming a composite structure thereby; and a pair of electrodes on either side of said composite structure and contiguous to said pair of active electroluminescent layers, said electrodes being adapted for receiving an excitation voltage thereacross, said pair of electroluminescent layers operating in conjunction with said insulating layer to provide not only emission of light energy, but also operating a current limiting means for any sustained discharge through said composite structure in the event of a voltage breakdown thereacross and preventing destruction of one or both of said electrodes.

2. The electroluminescent device as defined by claim 1 wherein said at least one pair of active electroluminescent layers are comprised of thin films.

3. The device as defined by claim 1 wherein said pair of electroluminescent layers and said insulating layer are comprised of thin films.

4. The device as defined by claim 1 wherein said pair of active electroluminescent layers are comprised of thin films of doped semiconductor material.

5. The electroluminescent device as defined by claim 1 wherein said pair of active electroluminescent layers are comprised of thin films of semiconductor material doped with manganese.

6. The electroluminescent device as defined by claim 1 wherein said pair of active electroluminescent layers are comprised of thin films of doped zinc sulfide (ZnS).

7. The electroluminescent device as defined by claim 1 wherein said pair of active electroluminescent layers are comprised of thin films of zinc sulfide (ZnS) doped with manganese (Mn).

8. The electroluminescent device as defined by claim 1 wherein said insulating layer is comprised of a transparent layer of dielectric material selected from the group including yttrium oxide ($Y_2O_3$), silicon nitride ($Si_3N_4$), aluminum oxide ($Al_2O_3$), and barium titanate ($BaTiO_3$).

9. The electroluminescent device as defined by claim 1 wherein said insulating layer is comprised of a thin film of yttrium oxide ($Y_2O_3$).

10. The electroluminescent device as defined by claim 1 wherein one of said pair of electrodes is comprised of indium-tin oxide $(In,Sn)O_2$ and the other electrode is comprised of aluminum (Al).

11. The electroluminescent device as defined by claim 1 and additionally including a substrate for supporting said composite structure and said pair of electrodes.

12. The electroluminescent device as defined by claim 1 and additionally including a transparent substrate for supporting said composite structure and said pair of electrodes and wherein said pair of active electroluminescent layers are comprised of thin films of ZnS:Mn and said insulating layer is comprised of a thin film of $Y_2O_3$.

13. The electroluminescent device as defined by claim 12 wherein one of said pairs of electrodes is located between said substrate and one of said pair of ZnS:Mn thin films and is comprised of a thin film of $(In,Sn)O_2$ and wherein the other electrode comprises an outer electrode adjacent said other ZnS:Mn thin films of said pair of electroluminescent layers, said outer electrode further comprising a layer of Al.

* * * * *